US009590297B2

(12) United States Patent
Ai et al.

(10) Patent No.: US 9,590,297 B2
(45) Date of Patent: Mar. 7, 2017

(54) MULTI-INPUT MULTI-OUTPUT ANTENNA SYSTEM

(75) Inventors: Hao Ai, Shenzhen (CN); Hui Jiang, Shenzhen (CN); Lu Zhang, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 0 days.

(21) Appl. No.: 13/641,759

(22) PCT Filed: Apr. 29, 2011

(86) PCT No.: PCT/CN2011/073565

§ 371 (c)(1),
(2), (4) Date: Oct. 17, 2012

(87) PCT Pub. No.: WO2012/071848

PCT Pub. Date: Jun. 7, 2012

(65) Prior Publication Data

US 2013/0241793 A1 Sep. 19, 2013

(30) Foreign Application Priority Data

Dec. 1, 2010 (CN) ..... 2010 1 0569432

(51) Int. Cl.
*H01Q 1/52* (2006.01)
*H01Q 1/38* (2006.01)
(Continued)

(52) U.S. Cl.
CPC ..... *H01Q 1/523* (2013.01); *H01Q 1/243* (2013.01); *H01Q 1/38* (2013.01); *H01Q 1/50* (2013.01);
(Continued)

(58) Field of Classification Search
CPC ..... H01Q 1/38; H01Q 19/005; H01Q 3/26; H01Q 21/061; H01Q 1/52; H01Q 1/521; H01Q 1/523
(Continued)

(56) References Cited

U.S. PATENT DOCUMENTS

2005/0243001 A1* 11/2005 Miyata et al. ..... 343/702
2006/0038736 A1* 2/2006 Hui et al. ..... 343/835
(Continued)

FOREIGN PATENT DOCUMENTS

CN 101577366 A 11/2009
CN 101673873 A 3/2010
(Continued)

OTHER PUBLICATIONS

International Search Report for PCT/CN2011/073565 dated Aug. 17, 2011.

*Primary Examiner* — Sue A Purvis
*Assistant Examiner* — Daniel J Munoz
(74) *Attorney, Agent, or Firm* — Ling Wu; Stephen Yang; Ling and Yang Intellectual Property

(57) ABSTRACT

The present invention discloses a multi-input multi-output antenna system comprising a first radiation unit, a second radiation unit, a radiation floor, a dielectric plate and a parasitic element. The first radiation unit, the second radiation unit and the parasitic element are printed on an upper surface of the dielectric plate, and the radiation floor is printed on a lower surface of the dielectric plate. The first radiation unit and the second radiation unit are planar monopole antennas, and the parasitic element is positioned between the first radiation unit and the second radiation unit. The system in accordance with the present invention can implement miniaturization of the antennas, and ensure two ports of an antenna have high isolation while maintaining good radiation performance.

2 Claims, 10 Drawing Sheets

(51) Int. Cl.

| | |
|---|---|
| ***H01Q 9/42*** | (2006.01) |
| ***H01Q 21/28*** | (2006.01) |
| ***H01Q 1/24*** | (2006.01) |
| ***H01Q 1/50*** | (2006.01) |

(52) U.S. Cl.
CPC ..... *H01Q 1/521* (2013.01); *H01Q 9/42* (2013.01); *H01Q 21/28* (2013.01)

(58) Field of Classification Search
USPC ..... 343/700 MS, 853
See application file for complete search history.

(56) References Cited

U.S. PATENT DOCUMENTS

| | | | | |
|---|---|---|---|---|
| 2006/0097919 | A1* | 5/2006 | Puckey | H01Q 1/243 343/700 MS |
| 2008/0055181 | A1* | 3/2008 | Kawaguchi et al. | 343/850 |
| 2009/0066600 | A1* | 3/2009 | Rabinovich | 343/793 |
| 2010/0315313 | A1* | 12/2010 | Wu | H01Q 1/2291 343/893 |
| 2011/0122040 | A1* | 5/2011 | Wakabayashi | 343/833 |
| 2011/0267245 | A1* | 11/2011 | Park et al. | 343/722 |
| 2012/0013519 | A1* | 1/2012 | Hakansson et al. | 343/835 |
| 2012/0139793 | A1* | 6/2012 | Sharawi | 343/700 MS |

FOREIGN PATENT DOCUMENTS

| | | | |
|---|---|---|---|
| CN | 101895010 | A | 11/2010 |
| EP | 1748516 | A1 | 1/2007 |
| EP | 2048739 | A1 | 4/2009 |
| JP | 2002330019 | A | 11/2002 |
| JP | 2008028734 | A | 2/2008 |
| JP | 2009105503 | A | 5/2009 |
| JP | 2009253959 | A | 10/2009 |
| JP | 2010153973 | A | 7/2010 |
| WO | 2007101480 | A1 | 9/2007 |

* cited by examiner

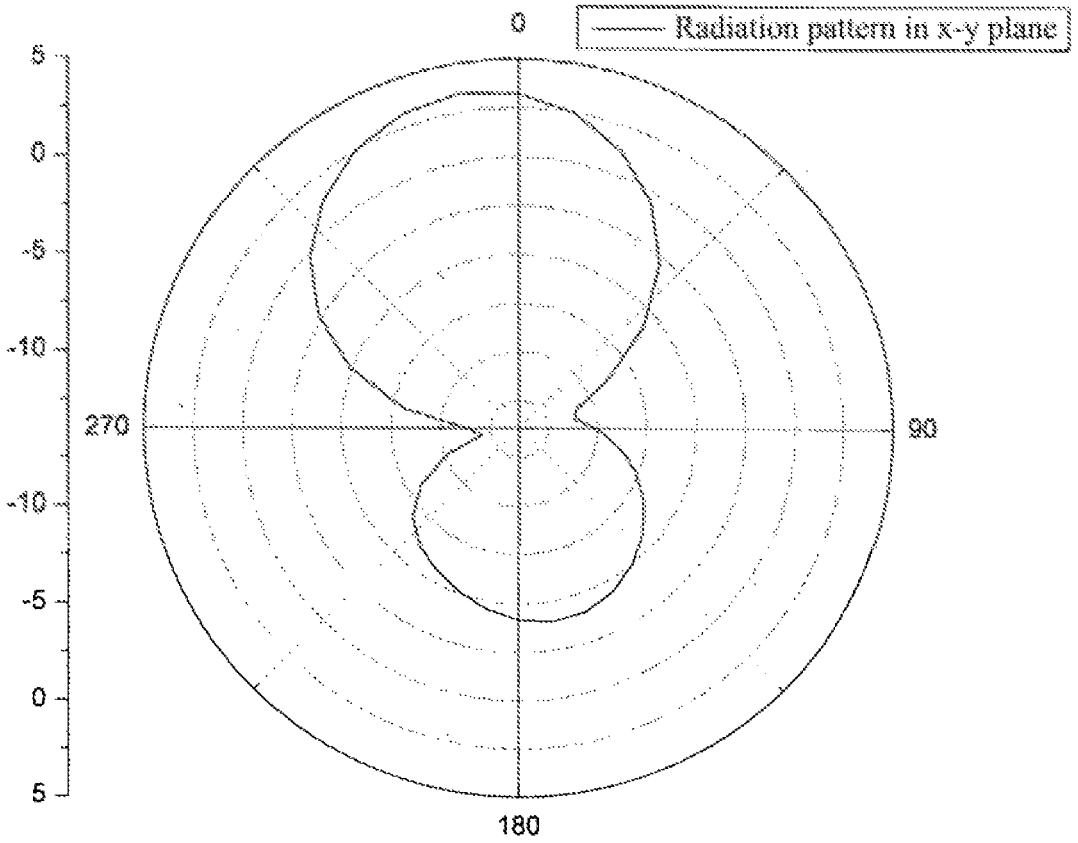
FIG. 10-(a)

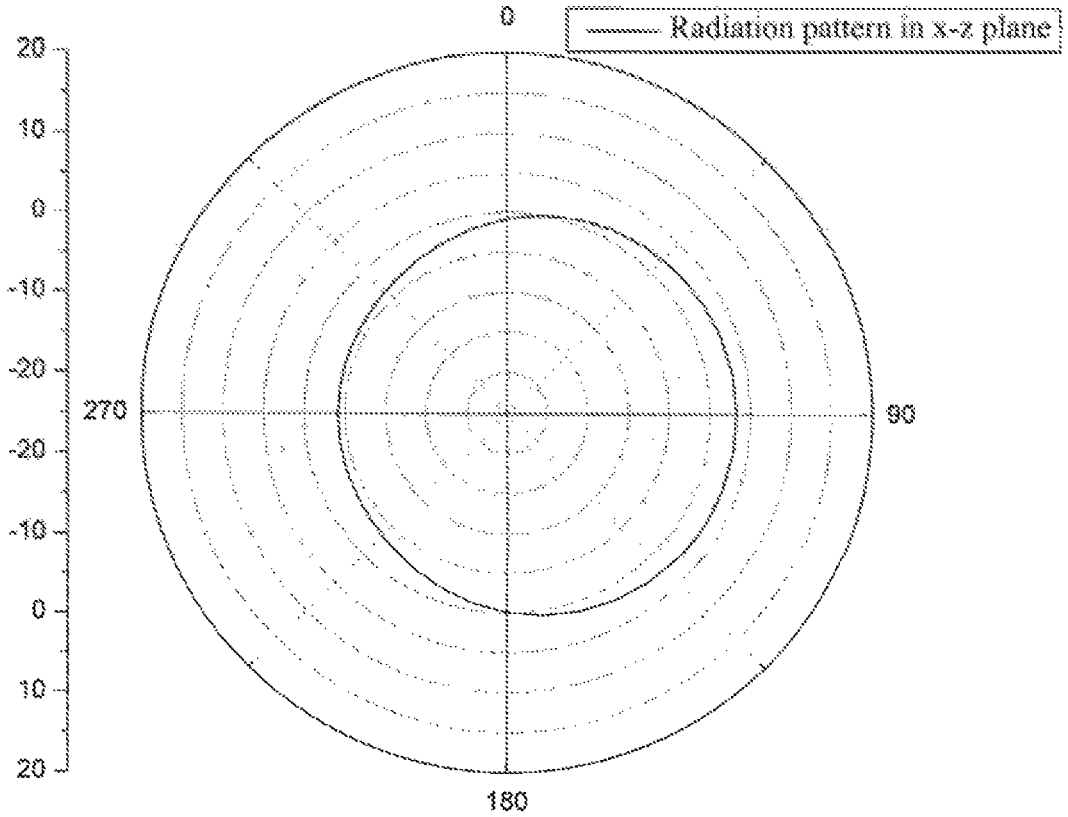
FIG. 10-(b)

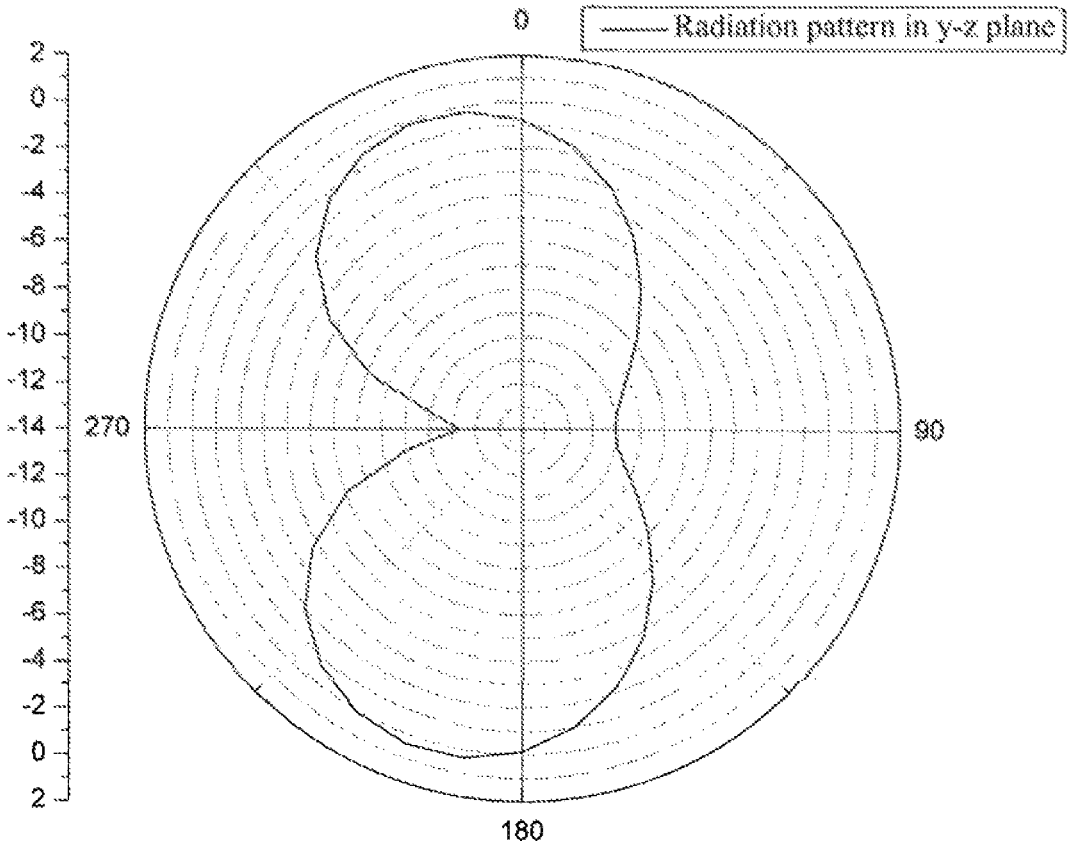
FIG. 10-(c)

MULTI-INPUT MULTI-OUTPUT ANTENNA SYSTEM

TECHNICAL FIELD

The present invention relates to the field of wireless communications, and more particularly, to a MIMO (Multiple Input Multiple Output) antenna system.

BACKGROUND OF THE RELATED ART

With the rapid development of the wireless communication technology, the serious shortage of frequency resources has increasingly become a bottleneck which restrains the development of the wireless communication industry. The wireless communication is developing towards the direction of large capacity, high transfer rate and high reliability such that how to maximize the spectrum utilization rate for limited spectrum resources has become a hot subject in current research. With the development of the LTE (Long Term Evolution) industry, currently MIMO antenna systems necessary for 4G have brought new challenges to terminal antenna design and evaluation: on the one hand, users require user experience of miniaturization and high quality, on the other hand, the MIMO antenna systems require that each antenna have the balanced radio frequency and electromagnetic performance while having high isolation and low correlation coefficients. Contradictions in many aspects have been manifested in design and system scheme stages of LTE terminal antennas. To sum up, research achievements in the wireless communication technologies in the past two decades, whether the conventional transmitter diversity or receiver diversity, or the smart antenna technology, is not sufficient to meet today's demand on large channel capacity and high-quality communications. The most important technology used to improve spectrum efficiency or increase communication capacity is the multi-antenna high isolation technology.

The MIMO technology, which is a great breakthrough in the field of wireless mobile communication, is a multi-antenna technology, that is, both a receiver and a transmitter in a wireless communication system are equipped with multiple antennas to create multiple parallel spatial channels, through which multiple information flows are transmitted simultaneously in the same frequency band so as to increase the system capacity greatly and improve the spectrum utilization efficiency. The core idea of the MIMO systems is space-time signal processing, that is, on the basis of the original time dimension, the spatial dimension is increased by using multiple antennas, thereby implementing multidimensional signal processing to obtain spatial multiplexing gain or spatial diversity gain. As an important means to improve the data transfer rate, the MIMO technology attracts people's great concern and is considered as one of alternative key technologies of the future new generation mobile communication systems (4G). Therefore, it has been researched extensively and attracts attention in recent years.

However, up to now, the MIMO technology has seldom implemented commercially in cellular mobile communication systems and is limited by some factors in applications in 3G. One of important factors is the antenna problem. Electrical properties and array configuration of antennas as receiving and transmitting means in the MIMO wireless communication system are important factors that affect the performance of the MIMO system. The number of array elements, array structure, array placement manner, design of antenna units and others directly affect spatial correlation of the MIMO channels. The MIMO system requires that the antenna elements in the array have relatively small correlation so as to ensure that a MIMO channel response matrix is nearly a full rank. However, due to limitations of size and structure of the receiver or transmitter, antenna elements usually are arranged in a limited space as many as possible such that miniaturization of the antennas and coupling between the multiple antennas have become one of problems required to be solved urgently.

Currently, there are many ways to decrease coupling between antennas, such as increasing the antenna spacing; introducing the EBG (Electromagnetic Band Gap) structure; and indenting in the floor. Increasing of the antenna spacing is often limited by the installation volume of antennas in practical applications; both introducing the EBG structure and indenting in the floor require a larger floor, which goes against miniaturization of the antennas as well.

CONTENT OF THE INVENTION

An object of the present invention is to overcome the shortcoming of large volume of existing low coupling multi-antenna and provides a new closely arranged and low coupling miniaturized antenna system which may be used in a MIMO system.

In order to solve the aforementioned problem, the present invention provides a multi-input multi-output antenna system comprising a first radiation unit, a second radiation unit, a radiation floor, a dielectric plate and a parasitic element. The first radiation unit, the second radiation unit and the parasitic element are printed on an upper surface of the dielectric plate, and the radiation floor is printed on a lower surface of the dielectric plate. The first radiation unit and the second radiation unit are planar monopole antennas, and the parasitic element is positioned between the first radiation unit and the second radiation unit.

Preferably, the antenna system further comprises a matching network comprising a first matching circuit and/or a second matching circuit. The first matching circuit is connected to the first radiation unit, and the second matching circuit is connected to the second radiation unit. Both the first matching circuit and the second matching circuit are composed of one or more lumped elements.

Preferably, the first matching circuit comprises an inductor $L_1$, one end of which is connected to the first radiation unit, and the other end is a feeding point.

The second matching circuit comprises a capacitor C, an inductor $L_2$ and an inductor $L_3$ which are connected in sequence. One end of the capacitor C is connected to the second radiation unit, and the other end is connected to the inductor $L_2$. One end of the inductors $L_3$ is connected to the inductor $L_2$ and is a feeding point, and the other end is connected to a ground.

Preferably, both the first radiation unit and the second radiation unit are distributed in diagonal positions of the upper surface of the dielectric plate and are composed of zigzag microstrip lines.

Preferably, the radiation floor is a rectangle with corners cut and is made of a copper foil printed in the middle of the lower surface of the dielectric plate.

Preferably, the parasitic element is rectangular and is composed of microstrip lines printed on the upper surface of the dielectric plate.

Preferably, the dielectric plate is a FR-4 rectangular dielectric plate with a dielectric constant of 4.4.

Compared with the prior art, the present invention has the following advantages:

1. The antenna units (radiation units) use a zigzag structure to implement miniaturization of the antennas.

2. The antennas are placed diagonally at the same side of the dielectric plate to ensure two ports of an antenna have high isolation while maintaining good radiation performance.

3. The parasitic element is introduced as a decoupling unit such that not only the problem of coupling between the antenna elements is solved effectively, but also the radiation unit far away from the parasitic element has a wide bandwidth in the required frequency band, while the coupling at other frequencies other than the central frequency in this frequency band is relatively small as well.

4. The radiation floor with a cut-off angle structure is used to implement matching using lumped elements within the limited space.

Theoretical calculation results show that the technologies described above enable the present invention to be widely used in various MIMO systems.

BRIEF DESCRIPTION OF DRAWINGS

FIG. 10 is a far-field gain pattern of a MIMO antenna system in accordance with an embodiment of the present invention, where (a) is a far-field pattern in the x-y plane, (b) is a far-field pattern in the x-z plane, and (c) is a far-field pattern in the y-z plane.

PREFERRED EMBODIMENTS OF THE PRESENT INVENTION

In a multi-antenna system, radiation is generated when a single antenna is excited. Since the spacing between antenna elements is small, scattering is caused due to interaction between adjacent antenna elements, and thus the isolation between antennas is low. Instead of using the traditional method for increasing the isolation in the multi-antenna system, the present invention decreases coupling between the adjacent antennas by placing a parasitic element between adjacent antennas as a reflection unit.

The monopole antenna structure is widely used in a variety of communications antenna designs. The present invention uses monopole antennas with the zigzag structure to implement miniaturization of the MIMO antennas. Load impedance of the antennas affects standing waves at the antenna ports, therefore after a decoupling unit is added in the multi-antenna system, impedance matching of the antennas is required to be performed. The present invention uses the lumped elements to perform matching of the antennas, and is more beneficial to miniaturization of the multi-antenna system compared to the traditional microstrip line matching, and meanwhile, the shape of the floor also affects matching of the antenna elements. Therefore, the present invention implements the matching of the antennas in conjunction with the lumped elements and the floor.

According to the principle described above, in the present invention, the monopole is used as the radiation unit in the multi-antenna system, the parasitic structure is introduced to improve the isolation between adjacent antenna elements, and impedance matching is implemented using the lumped elements.

Figure 1:
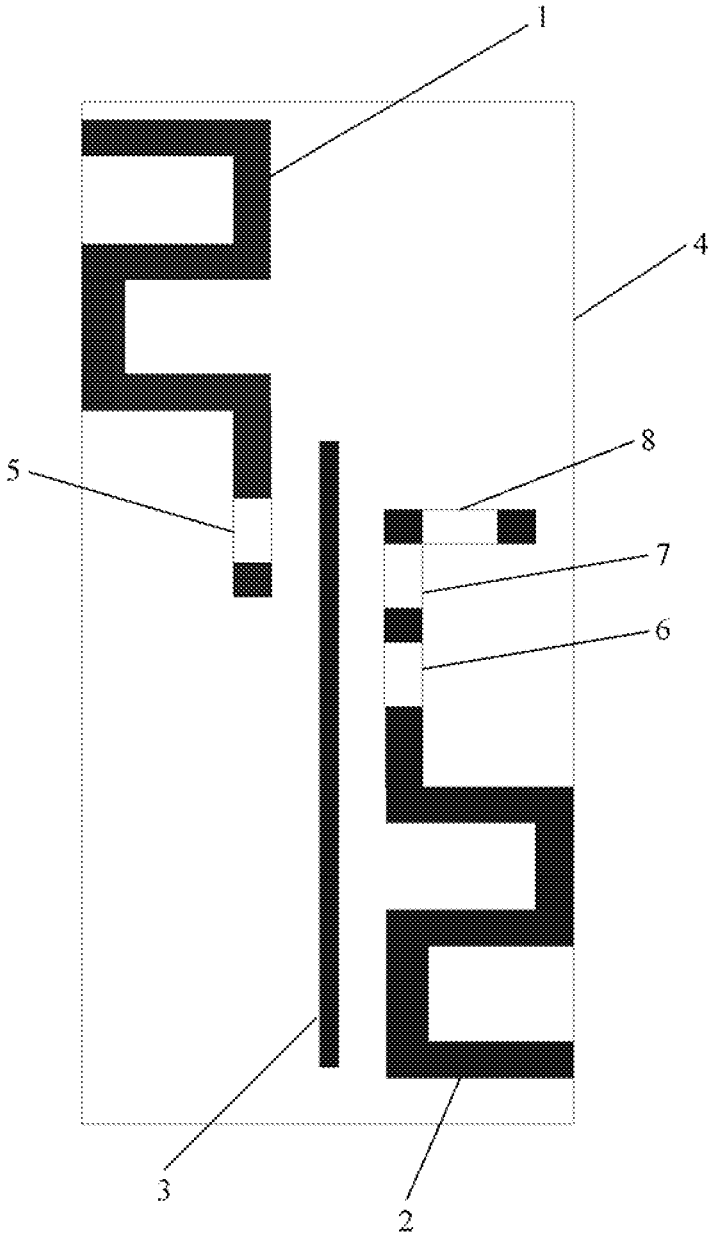
FIG. 1 is a top view of a MIMO antenna system in accordance with an embodiment of the present invention.
Figure 2:
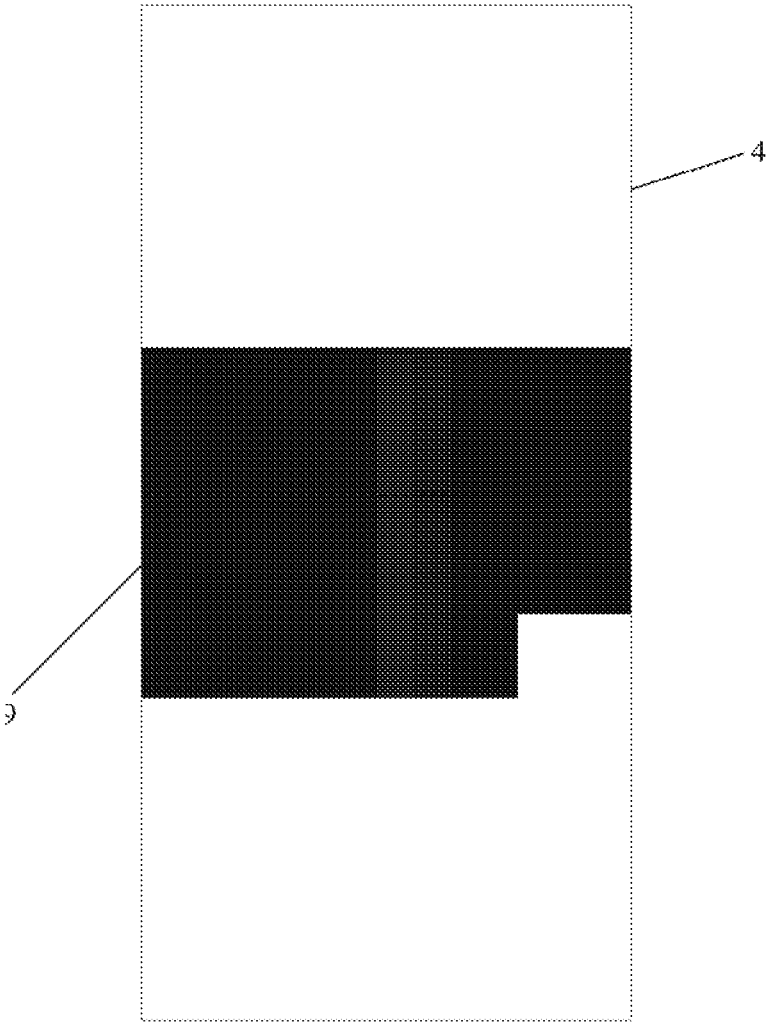
FIG. 2 is a bottom view of a MIMO antenna system in accordance with an embodiment of the present invention.

As shown in FIG. 1 and FIG. 2, a MIMO antenna system in accordance with an embodiment of the present invention comprises a first radiation unit 1, a second radiation unit 2, a radiation floor 9, a dielectric plate 4 and a parasitic element 3. The first radiation unit 1, the second radiation unit 2 and the parasitic element 3 are printed on an upper surface of the dielectric plate, and the radiation floor 9 is printed on a lower surface of the dielectric plate. The first radiation unit 1 and the second radiation unit 2 are planar monopole antennas, and the parasitic element 3 is positioned between the first radiation unit 1 and the second radiation unit 2.

Preferably, both the first radiation unit 1 and the second radiation unit 2 are distributed in diagonal positions of the upper surface of the dielectric plate 4 and are composed of zigzag microstrip lines.

Optionally, the antenna system in accordance with the present invention comprises a matching network. The matching network may comprise a first matching circuit and a second matching circuit, or only one of the matching circuits. The first matching circuit is connected to the first radiation unit, and the second matching circuit is connected to the second radiation unit. Both the first matching circuit and the second matching circuit consist of one or more lumped elements to implement load matching. As shown in FIG. 1, the first matching circuit comprises a lumped element 5 and the second matching circuit comprises lumped elements 6, 7 and 8.

Figure 3:
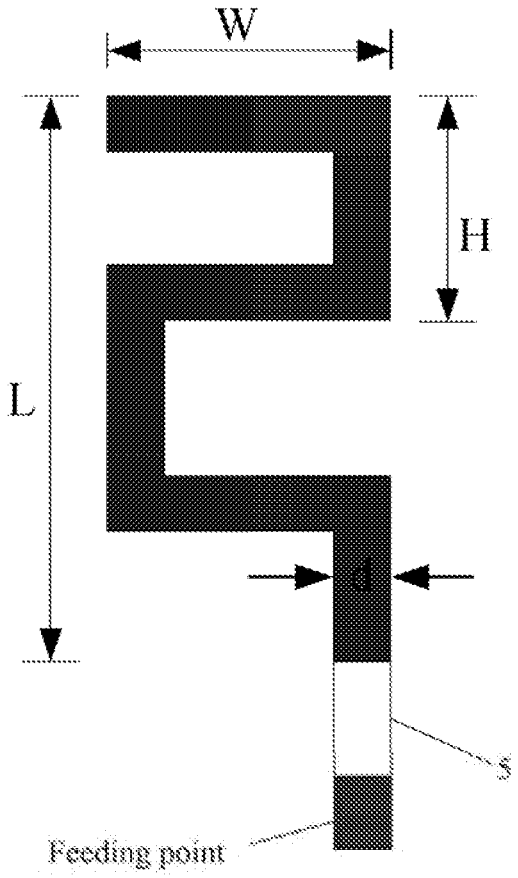
FIG. 3 is a schematic diagram of a first radiation unit and a first matching circuit in a MIMO antenna system in accordance with an embodiment of the present invention.

As shown in FIG. 3, the first radiation unit 1 is composed of the zigzag microstrip lines printed on the upper surface of the dielectric plate, and the lumped element 6 (i.e., inductor $L_1$) is used for impedance matching. One end of the inductor $L_1$ is connected to the first radiation unit 1, and the other end is a feeding point.

Figure 4:
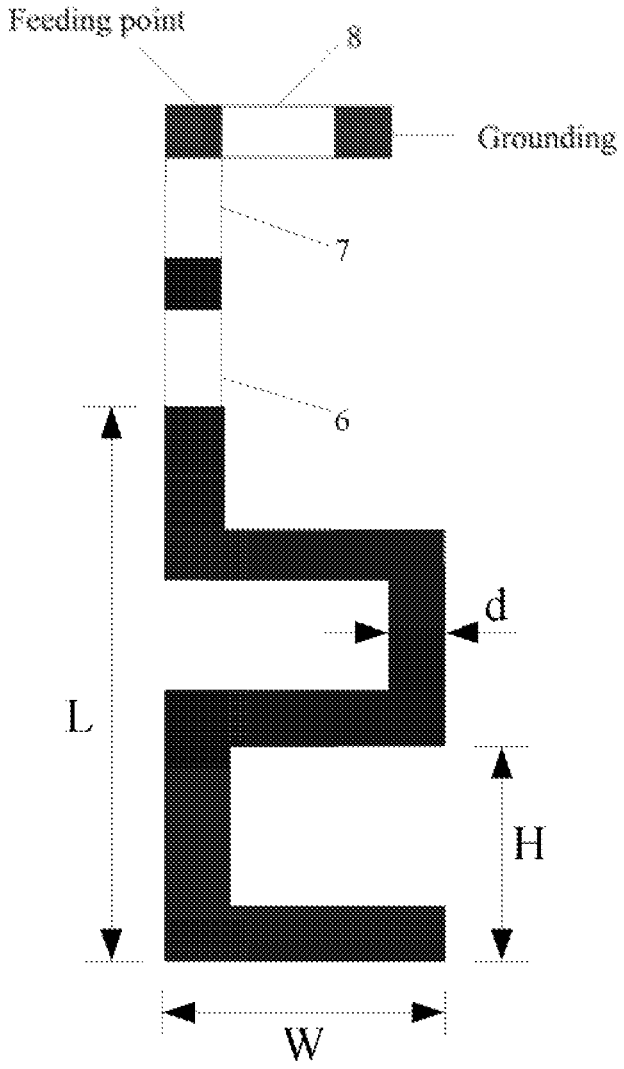
FIG. 4 is a schematic diagram of a second radiation unit and a second matching circuit in a MIMO antenna system in accordance with an embodiment of the present invention.

As shown in FIG. 4, the first radiation unit 2 is composed of the zigzag microstrip lines printed on the upper surface of the dielectric plate, and the lumped elements 6 (i.e., capacitor C), 7 (inductor $L_2$) and 8 (inductor $L_3$) are used for impedance matching. One end of the capacitor is connected to the second radiation unit, and the other end is connected to the inductor $L_2$. One end of the inductors $L_3$ is connected to the inductor $L_2$ and is a feeding point, and the other end is connected to a ground.

Figure 5:
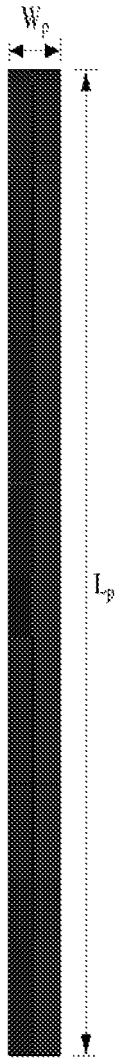
FIG. 5 is a schematic diagram of a parasitic element in a MIMO antenna system in accordance with an embodiment of the present invention.

As shown in FIG. 5, the parasitic element 3 is rectangular and is composed of the microstrip lines printed on the upper surface of the dielectric plate 4.

Figure 6:
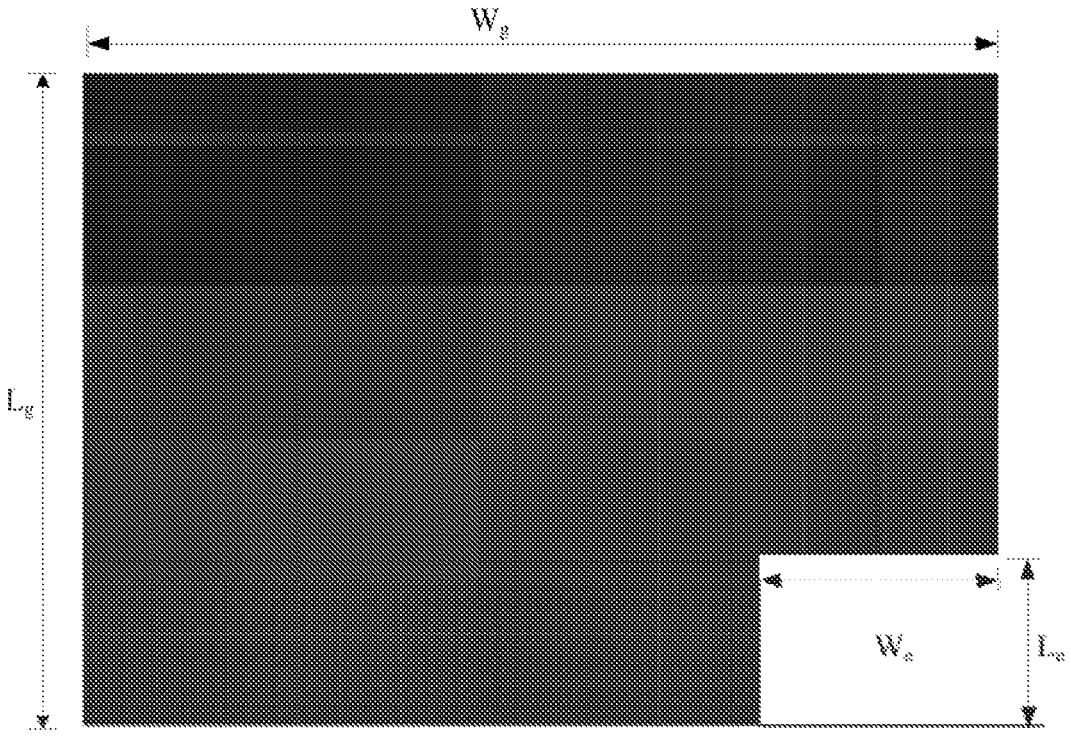
FIG. 6 is a structure diagram of a radiation floor in a MIMO antenna system in accordance with an embodiment of the present invention.

As shown in FIG. 6, the radiation floor 9 is a rectangle with corners cut and is made of a copper foil printed in the middle of the lower surface of the dielectric plate 4.

The dielectric plate 4 is a rectangle and is generally a FR-4 dielectric plate with a dielectric constant of 4.4. Its size might be 60 mm*20 mm*0.8 mm.

In the present invention, the two radiation units decrease correlation in a spatial diversity manner, and the relative position between the units ensures the performance of the antenna system in accordance with the present invention.

It can be seen from the above description that the present invention has the following features:

First, in the present invention, the multi-antenna system consists of two antennas, and their total size is 60 mm*20 mm*0.8 mm, which conforms to the MIMO system's requirements for miniaturization of the antennas.

Second, in the present invention, the correlation between two antennas is low, which conforms to use requirements of the MIMO.

Third, in the present invention, two planar monopole antennas are printed on the dielectric plate, thus production cost is low.

According to the structure described above, in the present invention, a specific application example of a multi-antenna system consisting of two antennas for the MIMO system is designed and will be described below.

The radiation unit 1 is a planar monopole antenna, dimensions of a microstrip line printed on a rectangular dielectric plate, of which thickness is 0.8 mm, relative permittivity is 4.4, and size is $L_s$*$W_s$=60 mm*20 mm, is L*W=19 mm*7 mm, d=1.5 mm, H=9.5 mm, and an inductor $L_1$=3.3 nH is used for impedance matching.

The radiation unit 2, which is a planar monopole antenna, has the same size as that of the radiation unit 1 and is a microstrip line printed on a rectangular dielectric plate, of which thickness is 0.8 mm, relative permittivity is 4.4 and size is $L_s$*$W_s$=60 mm*20 mm. A capacitor C=1 pF, inductors $L_2$=4.3 nH and $L_3$=1.6 nH are used for impedance matching.

The parasitic element metal sheet 3 is a microstrip line printed on a rectangular dielectric plate, of which thickness is 0.8 mm, relative permittivity is 4.4, and size is $L_s$*$W_s$=60 mm*20 mm, and has a size of $L_p$*$W_p$=38 mm*1 mm.

The radiation floor 9 is a copper foil printed on a rectangular dielectric plate, of which thickness is 0.8 mm, relative permittivity is 4.4, and size is $L_s$*$W_s$=60 mm*20 mm, and has a total size of $L_g$*$W_g$=20 mm*20 mm. The size of a rectangular cut-off corner is $L_c$*$W_c$=4 mm*6 mm.

The matching network in the embodiments of the present invention uses the lumped elements. Specifically, what components are used and selection of resistance values of the components depend on actual impedance situations.

The two monopole antennas in the embodiments of the present invention can be replaced by monopole antennas with other shapes The two antennas in the embodiments of the present invention operate in the 2.4 GHz frequency band, and change in the size of the monopole antenna may change the operating frequency.

The advantages of the present invention may be further described through the following simulations and tests.

1. Simulation and Test Contents

The voltage standing wave ratio, the isolation and the far-field radiation pattern of the antennas in the embodiments described above are simulated and calculated using simulation software, and then a real object is made for measuring.

2. Simulation and Test Results

Figure 7:
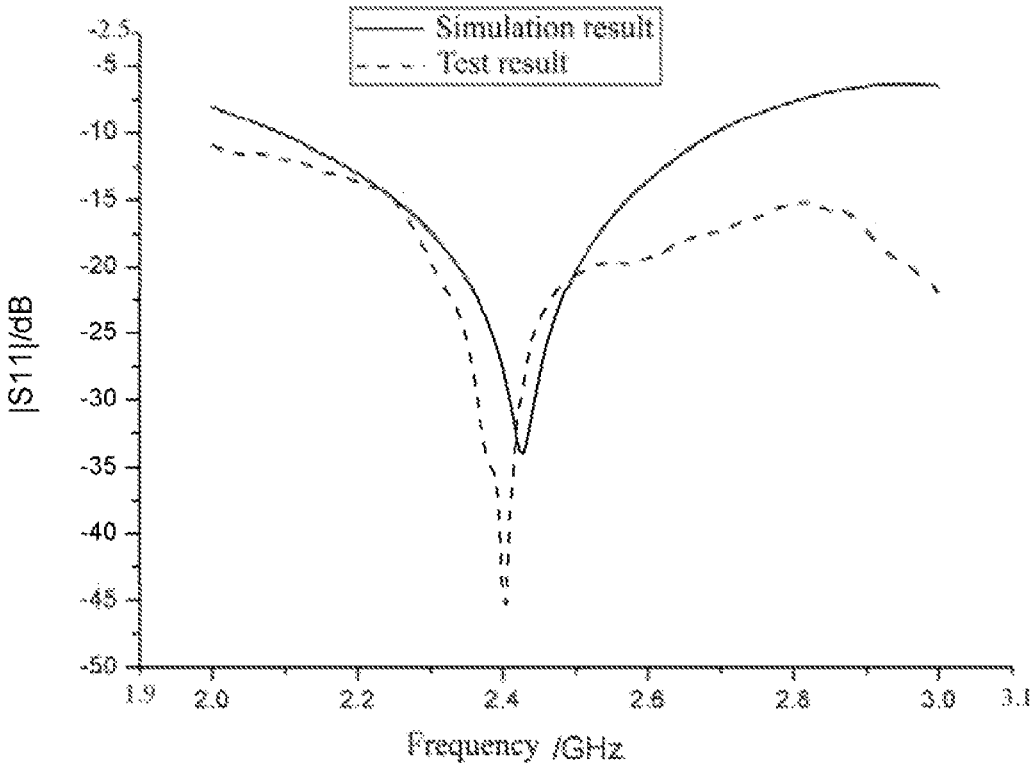
FIG. 7 is an operating frequency versus voltage standing wave ratio plot of a first radiation unit in a MIMO antenna system in accordance with an embodiment of the present invention.
Figure 8:
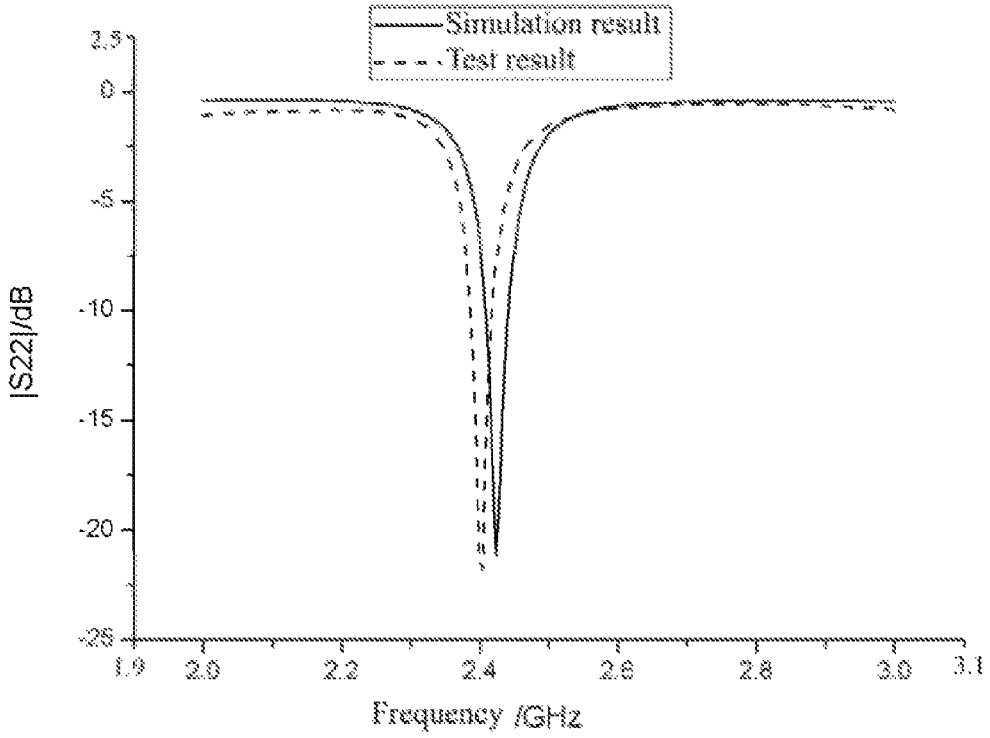
FIG. 8 is an operating frequency versus voltage standing wave ratio plot of a second radiation unit in a MIMO antenna system in accordance with an embodiment of the present invention.

FIG. 7 is an operating frequency versus voltage standing wave ratio plot of the first radiation unit, and FIG. 8 is an operating frequency versus voltage standing wave ratio plot of the second radiation unit. It can be seen from FIG. 7 and FIG. 8 that the reflection loss within the operating frequency band of 2.3 GHz-2.5 GHz is relatively low. In particular, the operating frequency band of 2.4 GHz is covered.

Figure 9:
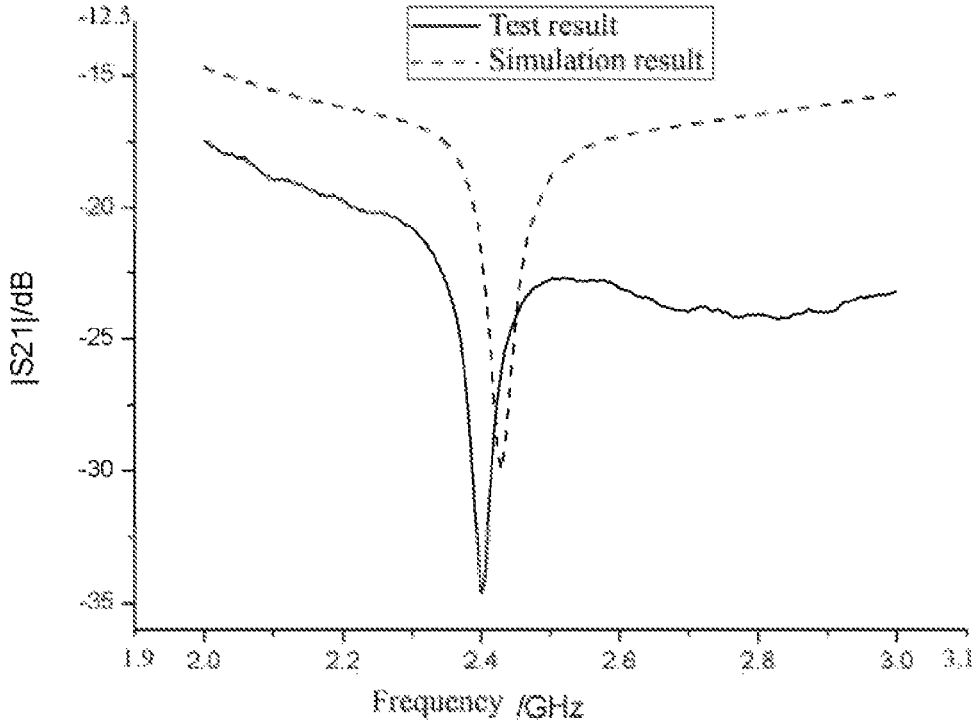
FIG. 9 is an isolation plot between two radiation units in a MIMO antenna system in accordance with an embodiment of the present invention.

FIG. 9 shows the isolation between two radiation units. It can be seen from FIG. 9 that coupling between the radiation units in an antenna system in the present invention can be inhibited in the operating frequency band effectively.

FIG. 10 is a far-field gain pattern of a multi-antenna system, where (a) is a far-field pattern in the x-y plane, (b) is a far-field pattern in the x-z plane, and (c) is a far-field pattern in the y-z plane. It can be seen from FIG. 10 that the antenna system in accordance with the present invention has very good omni-directivity.

It may be understood by those skilled in the art that all or some of the steps in the described method can be implemented by related hardware instructed by programs which may be stored in computer readable storage mediums, such as read-only memory, disk or CD-ROM, etc. Alternatively, all or some of the steps in the embodiments described above may also be implemented using one or more integrated circuits. Accordingly, each module/unit in the embodiments described above may be implemented in a form of hardware, or software functional module. The present invention is not limited to combinations of hardware and software in any particular form.

The above description is only the preferred embodiments of the present invention and is not intended to limit the present invention. Various modifications and variations to the present invention may be made by those skilled in the art. Any modification, equivalent substitution and variation made within the spirit and principle of the present invention should be covered in the protect scope of the present invention.

INDUSTRIAL APPLICABILITY

Compared with the prior art, the multi-antenna system in accordance with the present invention consists of two antennas, and their total size is 60 mm*20 mm*0.8 mm, which conforms to the MIMO system's requirements for miniaturization of the antennas; the correlation between two antennas is low, which conforms to use requirements of the MIMO; two planar monopole antennas are printed on the dielectric plate, thus production cost is low.

What is claimed is:

1. A multi-input multi-output antenna system comprising a first radiation unit, a second radiation unit, a radiation floor, a dielectric plate and a parasitic element, the first radiation unit, the second radiation unit and the parasitic element being printed on an upper surface of the dielectric plate, and the radiation floor being printed on a lower surface of the dielectric plate; the first radiation unit and the second radiation unit being planar monopole antennas, and the parasitic element being positioned between the first radiation unit and the second radiation unit;

wherein both the first radiation unit and the second radiation unit are distributed in diagonal positions of the upper surface of the dielectric plate and are composed of zigzag microstrip lines, and the parasitic element is a rectangle and is composed of microstrip lines printed on the upper surface of the dielectric plate;

wherein the parasitic element is a reflection unit for decreasing coupling between the first radiation unit and the second radiation unit, and the parasitic element is not connected to the first radiation unit and the second radiation unit;

wherein the radiation floor is a rectangle with one corner cut and is made of a copper foil printed in the middle of the lower surface of the dielectric plate;

the antenna system further comprising a matching network comprising a first matching circuit and/or a second matching circuit, the first matching circuit being connected to the first radiation unit, and the second matching circuit being connected to the second radiation unit, both the first matching circuit and the second matching circuit being composed of one or more lumped elements;

wherein the first matching circuit comprises an inductor $L_1$, one end of which is connected to the first radiation unit, and the other end is a feeding point; and the second matching circuit comprises a capacitor C, an inductor $L_2$ and an inductor $L_3$ which are connected in sequence, wherein one end of the capacitor C is connected to the second radiation unit, and the other end is connected to the inductor $L_2$, and one end of the inductors $L_3$ is connected to the inductor $L_2$ and is a feeding point, and the other end is connected to a ground.

2. The antenna system according to claim 1, wherein the dielectric plate is a FR-4 rectangular dielectric plate with a dielectric constant of 4.4.

* * * * *